US005911330A

United States Patent [19]

Chiles, II

[11] Patent Number: 5,911,330

[45] Date of Patent: Jun. 15, 1999

[54] CUP RACK

[76] Inventor: Randolph Ernest Chiles, II, 10031 Sand Bluff Hill, Catawissa, Mo. 63015

[21] Appl. No.: 08/721,726

[22] Filed: Sep. 27, 1996

[51] Int. Cl.[6] ..... A47G 29/00

[52] U.S. Cl. ..... 211/71.01; 211/75

[58] Field of Search ..... 211/71.01, 75, 211/72, 113, 87, 86.01, 88.02, 89.01; 248/312.1

[56] References Cited

U.S. PATENT DOCUMENTS

| | | | |
|---|---|---|---|
| 1,615,571 | 1/1927 | Crecelius | 211/75 X |
| 1,754,940 | 4/1930 | Freeman | 211/113 X |
| 1,977,190 | 10/1934 | Lassalle | 211/75 |
| 2,367,256 | 1/1945 | Atkins | 248/312.1 X |
| 2,793,762 | 5/1957 | Broussard | 211/113 |
| 3,001,678 | 9/1961 | Maxwell | 211/72 X |
| 3,552,612 | 1/1971 | Greis | 211/75 X |
| 4,577,765 | 3/1986 | Crosby | 211/75 |
| 5,125,519 | 6/1992 | Cambria | 211/113 X |
| 5,163,567 | 11/1992 | Betts, Sr. | 211/75 |
| 5,320,319 | 6/1994 | Winger et al. | 248/312.1 |

*Primary Examiner*—Jose V. Chen
*Attorney, Agent, or Firm*—John W. Kepler, III; Suelthaus & Walsh P.C.

[57] ABSTRACT

The cup rack is made of PVC foam board and holds 14-7 inch tall cups. The cup rack is 22 inches high, 30 inches wide, ¼ inch thick and holds 2 rows of cups, 7 in each row. Cups are held on the rack by a ½ inch offset metal clip at the top of each cup and 2 PVC foam board ledges running the width of the rack for the bottom of the cups to rest on, forming 2 horizontal rows. A Velcro Self Gripping One-Wrap strap inserted into a slot at each top comer mount the cup rack to any chain link fence or rail. A built-in carrying handle is a centered oval cut out at the top center of the rack. A 2 inch wide ledge formed by heating and bending the bottom front of the PVC foam board is located on the back side at the bottom of the rack for added stability.

7 Claims, 2 Drawing Sheets

CUP RACK

BACKGROUND OF THE INVENTION

The present invention relates to a cup rack for holding plastic cups for athletic teams of all kinds. The cup rack is constructed of PVC foam board and holds a maximum of 14 cups, 2 rows of 7 cups in each row, and provides for each cup to be 7 inches tall. The cups are held on the rack by a ½ inch offset metal clip at the top of each cup and a 1 inch wide flat ledge supporting the bottom of all cups, running the width of the rack. An additional 2 inch wide flat ledge formed by heating and bending the bottom of the PVC foam board is located on the back side at the bottom of the rack for added stability. The front ledges are made of PVC foam board and mounted on the rack with VC-1 cement to form a permanent bond. An oval cut out in the center top of the rack is the carrying handle. A 1 inch slot is cut at each end at the top of the rack, 1 on the extreme left, 1 on the extreme right, and a VELCRO SELF GRIPPING ONE-WRAP strap, ¾ inches wide and 12 inches long is inserted into each slot, to allow the cup rack to easily be mounted on any chain link fence or rail. The cup rack can also be set on a bench or on the ground for easy access by the team.

SUMMARY OF THE INVENTION

It is the object of the invention to provide a convenient, safe, compact way to organize and hold plastic cups at sporting events for team players in an effort to help stop the spread of germs caused by team players sharing the same cups by encouraging each team member to have their own cup, and to help the environment by reducing the amount of trash created by the use of paper and styrofoam cups by encouraging the use of reusable plastic cups.

BRIEF DESCRIPTION OF THE DRAWINGS

The present invention will be more fully understood by reference to the following detailed description thereof when read in conjunction with the attached drawings, and wherein.

DETAILED DESCRIPTION OF THE DRAWINGS

Figure 1:
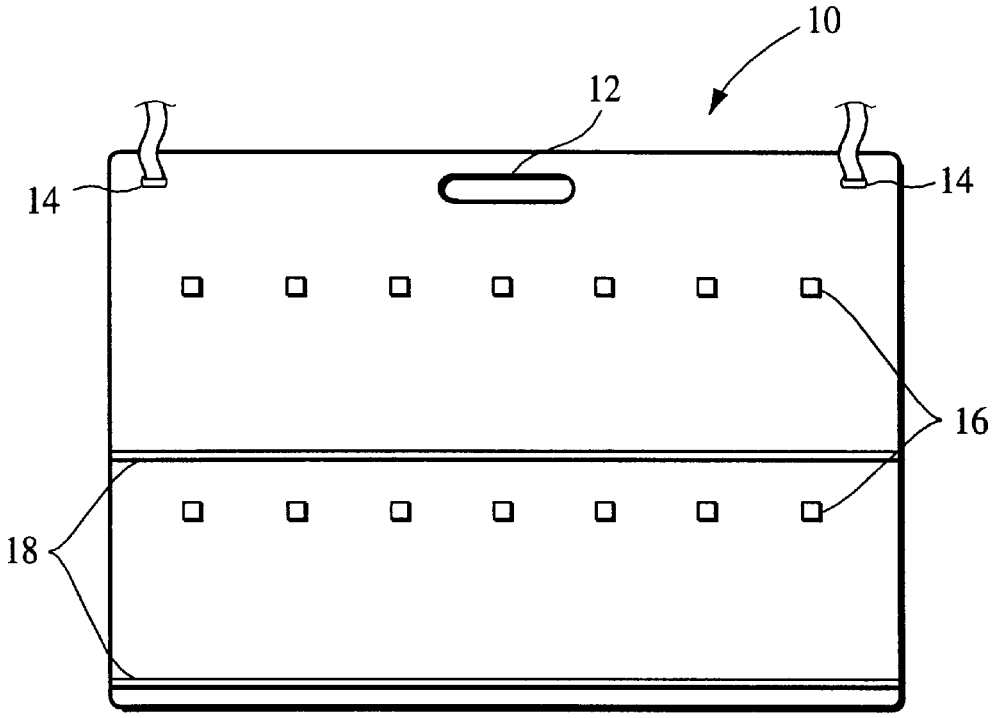
FIG. 1 is a front view of the cup rack showing placement and spacing for each cup on the rack, center oval carrying handle, slots at each end at the top with VELCRO SELF GRIPPING ONE-WRAP straps, a ½ inch offset metal clip for each cup and two 1 inch wide, 30 inch long PVC foam board ledges running the width of the rack to support the bottom of the cups in two rows.

The cup rack as shown in FIG. 1 front view measures 22 inches high and 30 inches wide. The center oval carrying handle measures 1¼ inch wide and 5 inches long and is 1 inch from the top, cut out centered on the rack. The slots at each end are cut out on the rack, each being 1 inch long and ½ inch wide with a VELCRO SELF GRIPPING ONE-WRAP strap inserted in each slot that is ¾ inch wide by 12 inches long. The rack is constructed of PVC foam board, ¼ inch thick, including the ledges which are constructed of the same PVC foam board material, ¼ inch thick. Front ledges are mounted on the rack using VC-1 cement to form a permanent bond, while the back ledge is formed by heating and bending the bottom of the rack to form a 2 inch ledge at the bottom back side of the rack for added stability. The ½ inch offset metal clips are coated with PLASTI DIP, a nontoxic rubber coating which is USDA accepted. The ½ inch offset metal clips are each held on the rack with a small metal rivet which is also coated with PLASTI DIP. Cups are placed on the rack by tilting the cups forward under the ½ inch offset metal clips, then resting the cups on the ledge below. The purpose of the ½ inch offset metal clips are to hold the cups in place while they rest on the ledges. There are 14-½ inch offset metal clips, 2 horizontal rows of 7 in each row, each ½ inch offset metal clip being 4 inches apart horizontally from each other with the first ½ inch offset metal clip in each row being 3 inches from the left edge and the last ½ inch offset metal clip in each row being 3 inches from the right edge of the front of the cup rack with each row of ½ inch offset metal clips being 7 inches vertically from each ledge. There are 2 ledges on the front of the cup rack, each 1 inch wide and 30 inches long, running horizontally the width of the rack to support the bottom of the cups in each row.

FIG. 1 shows the front view of the cup rack.

A portion 12 of a cup rack 10 illustrates a center oval carrying handle of the cup rack.

A portion 14 of the cup rack 10 indicates an upper right and left corner slots for the Velcro Self-Gripping One-Wrap straps with the straps inserted through the slots.

A portion 16 of the cup rack 10 illustrates a row of ½ inch offset metal clips.

A portion 18 of the cup rack 10 illustrates a plurality of horizontal ledges for the cups to rest on.

Figure 2:
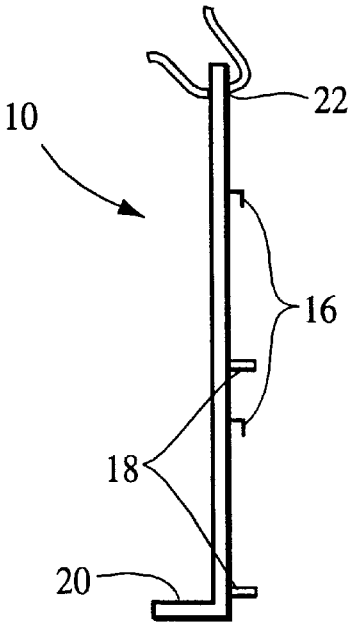
FIG. 2 is a side view of the cup rack as described in FIG. 1.

FIG. 2 shows a side view of the cup rack.

A portion 20 of the cup rack 10 illustrates a 2 inch ledge on the back bottom of the cup rack for stability.

A portion 22 of the cup rack 10 illustrates an the upper right corner slot for the Velcro Self-Gripping One-Wrap strap with the strap inserted through the slot.

The portion 16 of the cup rack 10 illustrates the rows of ½ inch offset metal clips.

The portion 18 of the cup rack 10 illustrates the horizontal ledges for the cups to rest on.

Figure 3:
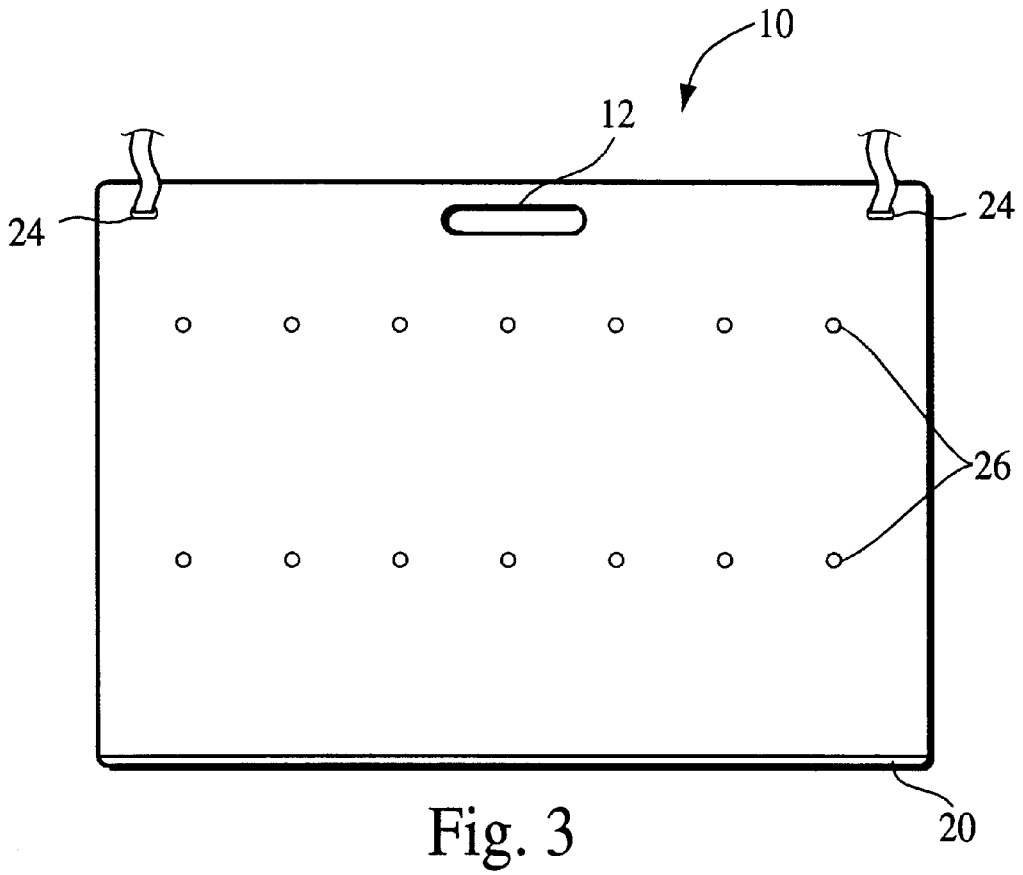
FIG. 3 is a rear view of the cup rack as described in FIG. 1.

FIG. 3 shows a rear view of the cup rack.

The portion 12 of the cup rack 10 illustrates the center oval carrying handle of the cup rack.

A portion 24 of the cup rack 10 illustrates an the upper right and left corner slots and a plurality of Velcro Self-Gripping One-Wrap straps with the straps inserted through the slots.

A portion 26 of the cup rack 10 illustrates a back of the metal rivet washer which secures each ½ inch offset metal clip on the rack.

The portion 20 of the cup rack 10 illustrates the the 2 inch ledge formed at the bottom of the cup rack for added stability.

Figure 4:
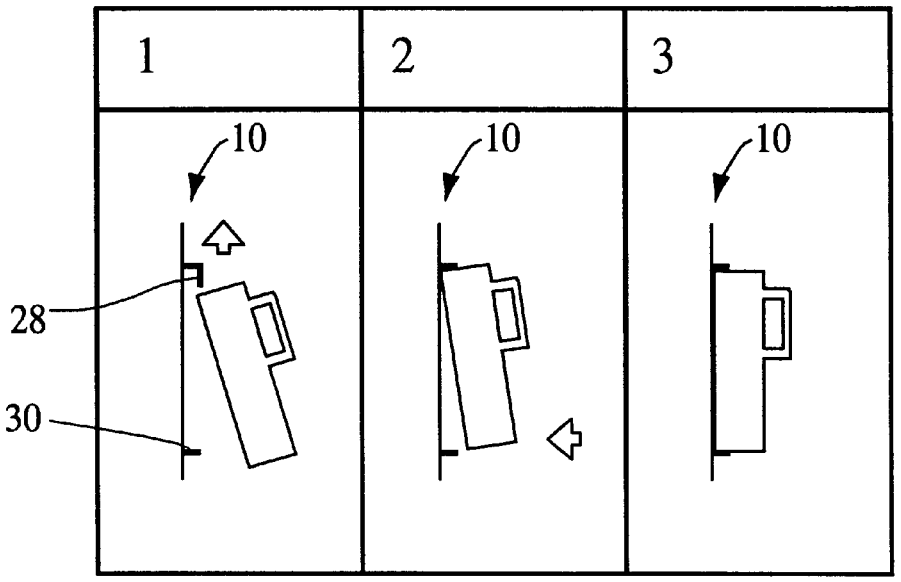
FIG. 4 is the process for putting cups on the rack (side view).

FIG. 4 shows the process of putting a cup on the rack.

FIG. 4 illustrates the tilting forward and upward of the cup to place it on the rack.

A portion 28 of the cup rack 10 illustrates a ½ offset metal clip.

A portion 30 of the cup rack 10 illustrates a 1 inch ledge for the cup to rest on.

FIG. 4 shows the operation of the cup rack 10 and, more particularly, illustrates one method for pushing forward of the cup bottom to place it on the rack.

FIG. 4 shows the final placement of the cup on the rack.

I claim:

1. A cup rack for holding cups at athletic and sporting events which can be set on a bench, on the ground or mounted on chain link fence or rail, comprising:

a cup rack including a plate member having a front and back face, the cup rack including a carrying handle and plurality of slots at least two slots in each top corner on the cup rack;

hook and loop straps inserted into at least 2 slots, 1 strap in each top corner on the cup rack;

the carrying handle further comprising an oval cut out at the top of the cup rack;

a plurality of ½ inch offset metal clips to stabilize one or more cups in place upon means for supporting the one or more cups, the metal clips mounted on the front face of the plate, the means for supporting the one or more cups positioned on the front of the plate and positioned with respect to the clips;

the means for supporting the one or more cups further including a plurality of horizontal ledges for one or more cups to rest on; and an additional horizontal ledge at the bottom on the back of the cup rack for added cup rack stability, the additional horizontal ledge extending along the bottom length of the back plate.

2. The cup rack in claim 1, being constructed of PVC foam board and 22 inches high, 30 inches wide and ¼ inch thick.

3. The cup rack in claim 1, having 14-½ inch offset metal clips, 2 rows of 7 in each row, to hold cups in place while resting on 2 horizontal 1 inch wide ledges, each 30 inches long, also made of PVC foam board on the front of the cup rack and 1 horizontal 2 inch wide, 30 inch long ledge, also made of PVC foam board and formed by heating and bending the bottom of the rack for added stability.

4. The cup rack in claim 1, having ½ inch offset metal clips as mentioned in claim 3 are coated with a nontoxic rubber coating which is USDA accepted and the ½ inch offset metal clips are held on the rack with a small metal rivet which is also coated with a nontoxic rubber coating.

5. The cup rack in claim 1, having hook and loop straps are each 12 inches long and ¾" wide, and are inserted into slots at left and right top corners of cup rack, each slot being 1 inch long, ½ inch wide as a means of mounting the cup rack on a chain link fence or rail.

6. The cup rack in claim 1, having ledges which are constructed of PVC foam board are mounted on the cup rack using a permanent cement to form a permanent bond, with 2-1 inch wide ledges on the front of the rack for cups to rest on and 1-2 inch wide ledge on the back of the rack for added stability, formed by heating and bending the bottom of the rack, creating a continuous ledge on the back side bottom of the rack.

7. The cup rack in claim 1 has no sharp edges of any kind with PVC foam board being rounded on all edges including cut out slots, cut out oval carrying handles and ledges on front and back, ½ inch offset metal clips are coated with nontoxic rubber coating, hook and loop straps are soft to the touch.

* * * * *